United States Patent [19]

Lodge

[11] Patent Number: 4,693,381

[45] Date of Patent: Sep. 15, 1987

[54] FLOATING HANGER MERCHANDISE RACK AND METHOD

[75] Inventor: Edith M. Lodge, Denver, Colo.

[73] Assignee: The Gates Rubber Company, Denver, Colo.

[21] Appl. No.: 801,356

[22] Filed: Nov. 25, 1985

[51] Int. Cl.[4] ..... A47F 5/08

[52] U.S. Cl. ..... 211/94; 40/16.2; 211/59.1; 248/220.2; 248/225.1

[58] Field of Search ..... 211/94, 106, 59.1, 57.1; 248/220.2, 225.1; 40/16.2, 16.4

[56] References Cited

U.S. PATENT DOCUMENTS

| | | | |
|---|---|---|---|
| 1,781,991 | 11/1930 | Stover | 211/94 X |
| 4,094,415 | 6/1978 | Larson | 211/94 X |
| 4,308,961 | 1/1982 | Kunce | 211/57.1 X |
| 4,453,324 | 6/1984 | Greenberger | 40/16.2 X |
| 4,509,648 | 4/1985 | Govang et al. | 248/220.2 X |
| 4,526,335 | 7/1985 | Garfinkle | 211/57.1 X |

*Primary Examiner*—Robert W. Gibson, Jr.
*Attorney, Agent, or Firm*—Frank P. Grassler; H. W. Oberg, Jr.; C. H. Castleman, Jr.

[57] ABSTRACT

A rack system for the display or storage of articles, which uses a hanger fabricated of a heavy gauge steel wire, so as to form a Z-shaped hanger having an article carrying portion in the middle, a retaining hook leg on one end, and a seating leg on the other end, which is seated within a trough that is attached to the front of a rack plate. The hanger is capable of sliding longitudinally back and forth along the front of the rack plate, but is prevented from upward escape by a channel, which has been affixed to the front of the rack plate, which channel holds identification tags, which are also able to freely slide back and forth along the front of the rack whenever the hangers are moved back and forth along the front of the rack. Also, there is described a method of rearranging articles by longitudinally sliding a hanger and its attendant identification tag whenever an inventory change occurs.

10 Claims, 5 Drawing Figures

FLOATING HANGER MERCHANDISE RACK AND METHOD

BACKGROUND OF THE INVENTION

The invention pertains to a rack for storage and display of articles, and more particularly, pertains to a rack whose individual hangers or hooks are capable of being freely displaced and repositioned.

In the past, arrangements for the storage and display of articles have generally included a hook or hanger structure upon which to hang articles for storage or display. Often, the hook or hanger was somehow permanently attached to a rack, as by being mechanically affixed to the rack by means of hardware, such as nuts and bolts, or by welding. Alternatively, means and methods were devised by which the hooks could be rearranged in order to increase the flexibility of the display system. A common means of doing this was to attach a hanger or peg to a flattened plate, which in turn would slide back and forth within the confines of a C-shaped panel.

Whenever a hook, hanger, or peg would be permanently affixed to a rack, this would present a problem in terms of making the display or storage system inflexible. Whenever it was desired to rearrange hangers, hooks, or pegs because of an inventory change, there was simply no way to do this without taking apart at least a portion of the rack. Although more flexibility was provided by sliding hangers or pegs along in a C-shaped channel, the hanger or peg itself was soldered, welded, or screwed into a flattened plate, which provided a point at which the hanger or peg would break off when the weight of the article became too great. This was frequently impractical when heavier weight articles needed to be hung, and therefore placed a limit on the usefulness of this system.

There is therefore a need in the art for a type of rack to store or display articles that will be flexible in terms of being able to rearrange the means holding those articles, and will also be structurally sound enough to hold heavier weight articles than previously devised flexible rack means.

It is therefore an object of the invention to provide a rack means for the hanging and display of articles, which can be readily rearranged, and which is capable of bearing heavier weight articles than such racks were capable of bearing in the past. It is another object of the invention to provide a means for identifying articles being stored or displayed on a given portion of the rack, and for being readily able to rearrange the means chosen for identification. It is yet another object of this invention to provide a strong hanger, which can readily be moved back and forth within its rack, and which does not rely upon any mechanical locking means for maintaining its position at a given spot on the rack.

The invention features a one-piece hanger, made of a suitable sturdy gauge of wire, which has been shaped so as to have a leg portion that seats within a U-shaped trough that is an integral part of the rack structure. The invention also features a channel, affixed to the face of the rack, in which identification means are inserted and within which they are moved. It is another feature of the invention that the channel for holding the identification means is positioned on the front of the rack so as to block upward and outward escape of the hanger, which is seated within its trough.

It is an advantage of the invention that a strong and sturdy hanger, hook or peg is able to move freely back and forth along the face of the rack in order to easily rearrange articles as desired. It is another advantage of the invention that identification means are easily inserted into the face of the rack, and are easily rearranged along with hooks as inventory is rearranged. It is yet another advantage of this invention, that although the hangers, hooks, or pegs are made to easily move back and forth along the rack, they cannot slip out or escape from the trough in which they are seated.

SUMMARY OF THE INVENTION

The present invention overcomes the problems and satisfies the needs previously considered by providing for a mounting strip having both length and width, and having a face side on the front of the rack. The mounting strip includes a member that forms a trough having a U-shaped configuration as viewed from a cross section, the trough having been given a predetermined depth, and having a substantially uniform slot on the face side of the mounting strip, that runs substantially longitudinally at least along a portion of the mounting strip. The rack also has at least one hanger shaped so as to have a leg portion that is angled from an article carrying portion, the leg portion being seated in the slot formed by the trough, and being free to slide along the slot, and being shaped or adapted so as to keep the article carrying portion fixed in a position that is generally perpendicular to the face of the mounting strip. The rack also includes a means for blocking escape of the hanger from the slot, even though it is still substantially able to move longitudinally along in the slot.

DETAILED DESCRIPTION OF THE DRAWINGS

Figure 1:
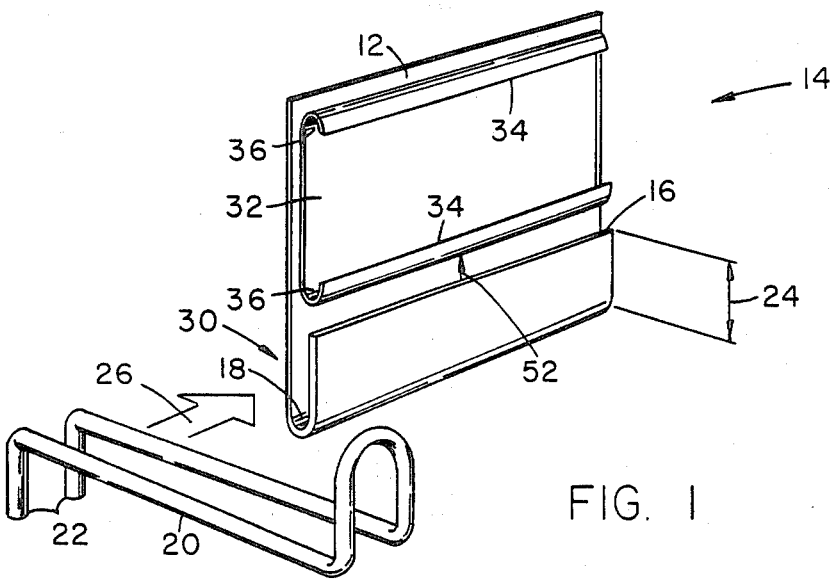
FIG. 1 is a perspective view of a portion of the floating hanger merchandise rack, and shows the means of insertion of an article-bearing hanger.

At FIG. 1, there is shown the mounting strip 12. The mounting strip 12 is essentially flat and rectangular in overall shape in the preferred embodiment. Most preferably, it is constructed of a piece of sheet metal of approximately 3/33 of an inch in thickness. However, it is to be understood that the thickness of the sheet metal may vary substantially according to the load-bearing requirements of the types of articles which are to be hung from the rack. The mounting strip 12 has a face aspect shown generally at 14. One lengthwise edge 16 of the mounting strip 12 is curled upwards on the face side 14 of the mounting strip so as to form a generally U-shaped trough 18 having a particular desired depth indicated by 24. Fabricating a trough by curling up a lengthwise edge of the mounting strip is a preferred way of creating the trough 18 since it is a simple way of achieving this structural feature. However, a trough may be separately fabricated out of a like or different material, which is then attached to the face of the mounting strip 12. There is also shown in FIG. 1 a secondary mounting strip 32, which has been affixed to the face side 14 of the mounting strip 12. The secondary mounting strip 32 is here shown to have two of its lengthwise edges 34 each curled inwardly to form two U-shaped troughs 36, somewhat analogous to the U-shaped trough 18 formed from the edge 16 of the mounting strip 12. However, the troughs of the secondary mounting strip 36 will be somewhat smaller in the preferred embodiment of the rack than the trough 18.

The U-shaped trough 18 of the mounting strip 12 is shown to have at its side an opening shown generally at 30, which is the point at which a hanger 20 is inserted. The hanger 20 is inserted generally along the line of direction shown by 26 such that the leg portion 22 of the hanger 20 slides into and is seated in the trough 18. In the most preferred embodiment of the invention, the length of the leg portion 22 of the hanger 20 will be no greater than the depth 24 of the trough 18.

Figure 2:
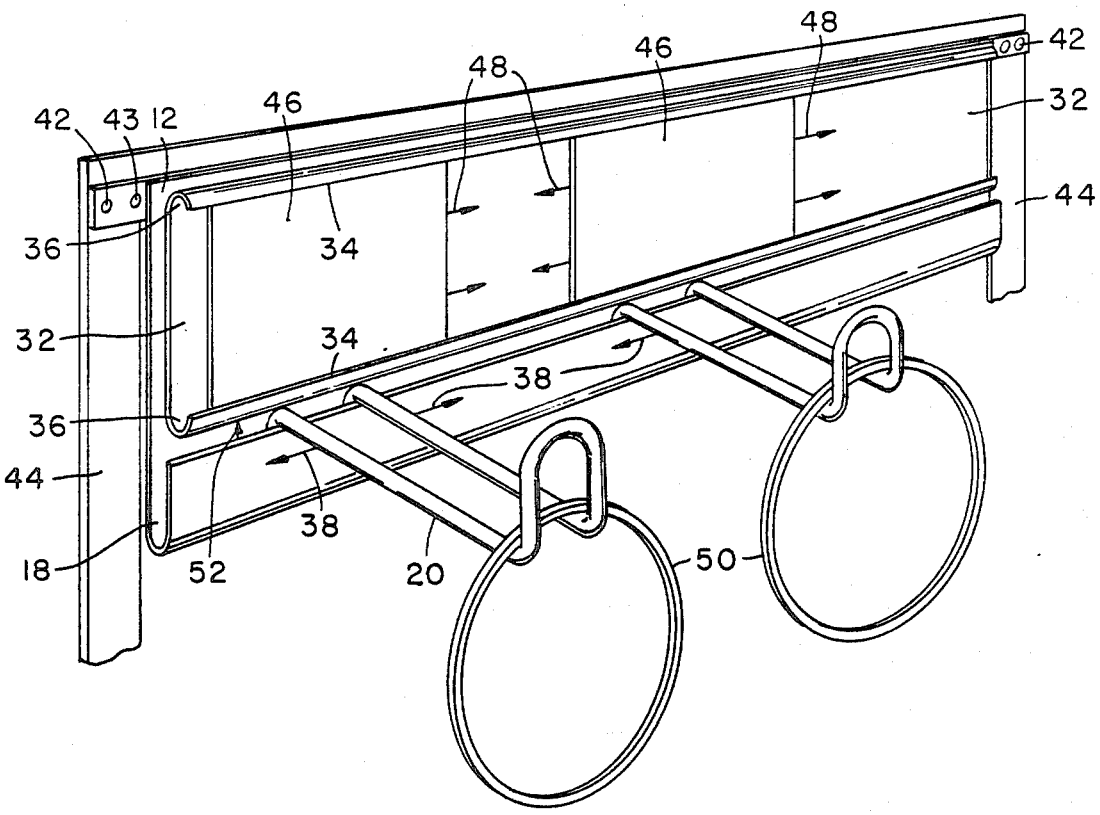
FIG. 2 shows, in perspective view, a complete section of the floating hanger merchandise rack, including articles for storage or display hung upon hangers, and accompanied by individual means for identifying those articles, while the rack itself is shown installed upon a means for supporting the rack.

Turning now to FIG. 2, there is shown generally the rack in its contemplated mode of operation. Hangers 20 have been inserted into the trough 18 and are seen to be capable of longitudinally sliding within the trough along lines of travel 38. Articles meant for storage or display 50 are hung on the hangers 20. The mounting strip 12 is seen to have attached to it fastening means 42, which fasten the mounting strip to a means for supporting the rack 44. There has been inserted into the secondary mounting strip 32 identification means 46 for the identification of the articles 50 that are hung from the hangers 20. The identification means 46 is essentially flat and rectangular, having a width chosen such that the identification means 46 is held along its lengthwise edges by the troughs 36 formed by the curled edges 34 of the secondary mounting strip 32. The means for identification of the stored or displayed articles are capable of freely sliding in longitudinal and essentially parallel directions indicated by lines of direction 48. The secondary mounting strip 32 can be seen to be fixably mounted onto the face 14 of the mounting strip 12 such that the lower surface of the secondary mounting strip 32, in this case shown to have been upwardly formed so as to form the trough 36, physically prevents upward escape of the hanger 20 along directions shown by the line of direction 52. In this manner, the hangers 20 cannot escape in upward direction 52, and yet are capable of freely sliding along longitudinally and essentially parallel directions 38.

Figure 3:
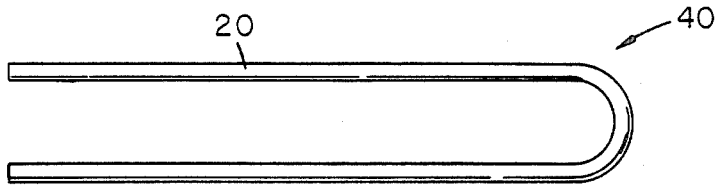
FIG. 3 is a top view of an individual hanger, showing its general U-shaped configuration.
Figure 4:
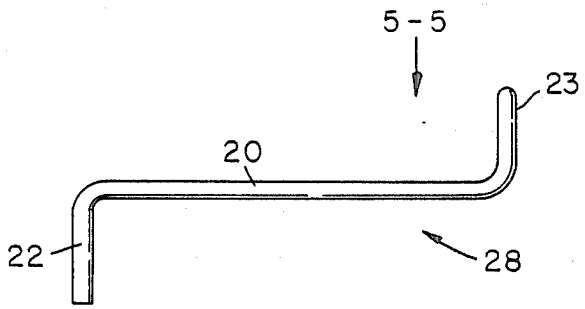
FIG. 4 is a side view of an individual hanger, showing its general Z-shaped configuration.
Figure 5:
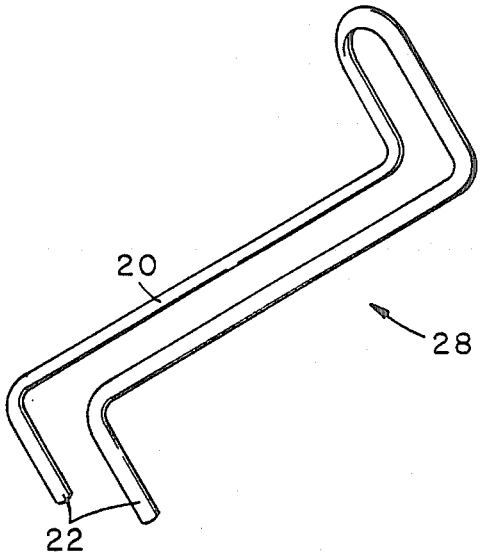
FIG. 5 is a view in perspective taken generally along the line 5—5 of FIG. 4, simultaneously showing the general Z-shaped configuration of the hook and the general U-shaped configuration of the hook by displaying its entire three dimensional conformation.

Turning now to FIG. 3, there is shown in top view an article carrying hanger 20, which is essentially U-shaped when viewed from this angle, as shown generally at 40. In FIG. 4 the same hanger 20 is shown in a sideways view, which shows the Z-shaped configuration that the hanger 20 takes on when looked at from this view. In this view there is now visible the hanger leg portion 22 of the hanger 20, as well as an added hanger carrying portion 23. FIG. 5, which is a view in perspective taken somewhat along the line 5—5 of FIG. 4, shows the overall three dimensional shape of the hanger 20, again showing the generally Z-shaped configuration 28, which the hanger takes on after fabrication. In FIG. 5 there is shown how the legs of the hanger 22 are, in one preferred embodiment of the invention, two separate legs.

The secondary mounting strip 32 may be affixed to the mounting strip 12 by any mechanical means. The most preferred means is to weld the secondary strip 32 onto the mounting strip 12. The mounting strip 12, the secondary mounting strip 32, and the fastening means 42, are all enamel coated in a desired color to improve the aesthetic appearance of the otherwise bare metal. Fastening means 42 can constitute any way of attaching an elongated rigid material to the mounting strip 12. In the most preferred embodiment, the fastening means 42 is integral and unitary with the mounting strip 12 and has one or more access holes 43 drilled into it, in order to fasten it against a means for support of the rack 44. The rack supporting means 44 may be any kind of columnar rigid material. In one preferred embodiment, the rack supporting means 44 is part of a larger overall apparatus in which the rack supporting means 44 recurs at regularly repeating intervals, so that discrete lengths of mounting strip 12 can be installed and attached in a repeating, modular fashion.

The hanger 20 is preferably fabricated from a suitably rigid material, and most preferably is a metal such as either aluminum or a suitable alloy of steel. The leg portion 22 of the hanger 20 has a substantially flat plane aspect, which means that when the leg portion 22 of the hanger 20 is seated within the U-shaped trough 18, that the hanger 20 is rigidly positioned more or less perpendicular to the face aspect 14 of the mounting strip 12, and does not swing back and forth. However, the dimensions of the hanger leg portion 22 are still such that within the trough 18, the hanger can slide back and forth along the face 14 along the directions indicated at 38. More or less parallel to the directions 38, the identification means 46 can slide in the directions indicated by 48. The significance of this is that when an article needs to be rearragned for whatever reason, the hanger that holds a given article can easily be repositioned. The identification means which goes along with that article and that hanger can then easily be repositioned as well, by simply sliding along in the secondary mounting strip.

The hanger leg portion 22 can be a flattened elongated strip in order to give it the necessary flat aspect to prevent rotation, or it can be formed of two or more members, which when lined up will have a flat plane orientation. In the most preferred version of the hanger, this is accomplished by orienting two legs of what is an essentially U-shaped piece of heavy-gauged steel wire so that they are essentially parallel. Then, the legs are bent simultaneously to form an angle with the body of the U-shaped piece is bent so as to be parallel and in a direction opposite to the bend of the leg portion 22, so as to form a member 23. In side view, this gives the hanger 20 an overall Z-shaped configuration 28.

The construction of the invention also permits a new method of storing and displaying articles, whereby a rack means is installed having hangers 20 that can freely slide parallel to the face 14 of the rack means. Articles are then arranged on the hangers, and means for identification of the articles are also then installed. Whenever an inventory change occurs, the articles are rearranged by sliding the hangers along the face 14 of the rack means. Also, the identification means can readily be moved to the rearranged position of the articles.

It is thought that the floating hanger merchandise rack apparatus and method of the present invention and many of its attendant advantages will be understood from the foregoing description and it will be apparent to those skilled in the art that various changes may be made in the form, construction, and arrangement of the parts thereof without departing from the spirit and scope of the invention or sacrificing all of its material advantages. The forms herein described are merely preferred embodiments, and the descriptions herein should not be construed or interpreted as the only embodiments, and the following claims should therefore be interpreted as broadly as reasonable.

What is claimed is:

1. A rack for storage and display comprising:

a primary mounting strip having a face that is oriented toward a front side of the rack, the mounting strip having at least one edge that is shaped so as to form a trough having a U-shaped configuration when viewed in cross section, the trough having a predetermined depth and defining a substantially uniform slot on the face side of the mounting strip, which is oriented substantially longitudinally in relation to at least a portion of the mounting strip;

at least one hanger having a leg portion angled from an article carrying portion, the leg portion disposed in the slot and free to slide along in the slot, and adapted to keeping the article carrying portion oriented generally perpendicular to the face of the mounting strip, and is fabricated from a rigid material that forms a U-shaped configuration when the hanger is viewed from the front and a Z-shaped configuration when the hanger is viewed from the side;

a secondary mounting strip fixably mounted onto the face of the primary mounting strip, and having at least two edges that have been shaped so as to form upper and lower secondary troughs, which each have a U-shaped configuration when viewed in cross section, the secondary troughs having predetermined and defining substantially uniform slots on the face side of the primary mounting strip, which are oriented substantially longitudinally in relation to at least a portion of the primary mounting strip and which are oriented substantially parallel to each other;

the secondary mounting strip being fixably mounted onto the face of the primary mounting strip at a position such that the lower trough of the secondary mounting strip blocks escape of the hanger from the slot of the primary mounting strip while at the same time permitting substantially longitudinal movement of the hanger along in the slot of the primary mounting strip; and fastening means for fixably mounting the rack to a means for supporting the rack.

2. A rack, as claimed in Claim 1, wherein the primary mounting strip, the secondary mounting strip, and the hanger are made of a suitble metallic material.

3. A rack, as claimed in Claim 1, wherein the primary mounting strip and the secondary mounting strip are made of a suitable sheet metal material.

4. A rack, as claimed in Claim 1, wherein the Z-shaped hanger is made of a suitable heavy gauge wire material.

5. A rack, as claimed in Claim 1, wherein the metallic primary mounting strip, secondary mounting strip, and hanger are enamel coated.

6. A rack, as claimed in Claim 2, wherein means for identification of articles hung from the Z-shaped hangers, are inserted into the secondary mounting strip.

7. A method of using a floating hanger merchandise rack for the storing and display of articles, comprising the steps of:

fabricating a primary mounting strip having an upwardly curled U-shaped trough formed on the front of the primary mounting strip;

fabricating a plurality of hangers having an article carrying portion and a leg portion;

inserting the leg portions of the hangers into the trough of the primary mounting strip, the hangers being able to slide freely substantially parallel to the front of the primary mounting strip;

arranging articles on the hangers;

installing means on the front of the rack for identification of the articles;

rearranging the hangers when an inventory change occurs by sliding the hangers along the face of the rack and by moving the identification means along the face of the rack to the rearranged position of the articles.

8. A rack for storage and display comprising:

a mounting strip having length and width, and having a face that is oriented towards a front side of the rack, the mounting strip including a member that forms a trough having a U-shaped configuration when viewed in cross-section, the trough having a predetermined depth and defining a substantially uniform slot which is on the face side of the mounting strip, and oriented substantially longitudinally in relation to at least a portion of the mounting strip;

at least one hanger having a leg portion angled from an article carrying portion, the leg portion disposed in the slot, free to slide along the slot and adapted to keeping the article carrying portion oriented generally perpendicular to the face of the mounting strip; and a secondary mounting strip fixably mounted onto the face of the mounting strip, having a length no greater than the length of the mounting strip, having a width lesser than the width of the mounting strip, and including two members that form upper and lower secondary troughs which each have a U-shaped configuration when viewed in crosssection, the secondary troughs having predetermined depths and defining substantially uniform slots on the face side of the mounting strip, which secondary trough slots are oriented substantially longitudinally in relation to at least a portion of the mounting strip, and which secondary trough slots are oriented substantially parallel to each other.

9. A rack apparatus, as claimed in claim 8, wherein the secondary mounting strip is fixably mounted onto the face of the mounting strip a position such that the lower secondary trough of the secondary mounting strip defines the escape blocking means.

10. A rack apparatus, as claimed in claim 9, wherein the secondary mounting strip blocks escape of the hanger from the slot of the mounting strip, while permitting substantially longitudinal movement of the hanger along in the slot of the mounting strip.

* * * * *